US007055184B2

(12) United States Patent
Humber

(10) Patent No.: US 7,055,184 B2
(45) Date of Patent: Jun. 6, 2006

(54) CLOSET FLANGE WITH KNOCKOUT RETAINER

(75) Inventor: Jeffrey A. Humber, Memphis, TN (US)

(73) Assignee: IPS Corporation, Collierville, TN (US)

( * ) Notice: Subject to any disclaimer, the term of this patent is extended or adjusted under 35 U.S.C. 154(b) by 9 days.

(21) Appl. No.: 10/749,729

(22) Filed: Dec. 30, 2003

(65) Prior Publication Data

US 2005/0138722 A1 Jun. 30, 2005

(51) Int. Cl.
*E03D 11/16* (2006.01)
*E03D 11/00* (2006.01)

(52) U.S. Cl. ..... 4/252.4

(58) Field of Classification Search ..... None
See application file for complete search history.

(56) References Cited

U.S. PATENT DOCUMENTS

| | | | | |
|---|---|---|---|---|
| 3,621,623 | A | 11/1971 | Downes | 52/20 |
| 3,800,486 | A | 4/1974 | Harvey | 52/98 |
| 3,805,052 | A | 4/1974 | Rambauske | 240/41.35 C |
| 3,846,851 | A | 11/1974 | Pepper | |
| 3,854,965 | A | 12/1974 | Niwa et al. | 106/62 |
| 3,856,050 | A | 12/1974 | Rooney | 138/96 |
| 3,942,681 | A | 3/1976 | Richardson | 220/324 |
| 4,014,368 | A | 3/1977 | Nelsen | 138/109 |
| 4,207,630 | A | 6/1980 | Bressler | 4/252 |
| 4,212,486 | A | 7/1980 | Logsdon | 285/4 |
| 4,233,697 | A | 11/1980 | Cornwall | 4/293 |
| 4,406,480 | A | 9/1983 | Izzi | 285/12 |
| 4,423,753 | A | 1/1984 | Smith et al. | 138/89 |
| 4,732,397 | A | 3/1988 | Gavin | 277/207 |
| 4,805,920 | A | 2/1989 | Gavin | 277/207 |
| 4,827,539 | A | 5/1989 | Kiziah | |
| 4,915,137 | A | 4/1990 | Hall | 138/96 R |
| 5,043,536 | A | 8/1991 | DeBartolo, Jr. | 174/65 R |
| 5,115,554 | A | 5/1992 | Fell, Sr. | |
| 5,265,752 | A | 11/1993 | Olson | 220/380 |
| 5,329,971 | A | 7/1994 | Condon | |
| 5,377,361 | A | 1/1995 | Piskula | |
| 5,624,123 | A | 4/1997 | Meyers | 277/9 |

FOREIGN PATENT DOCUMENTS

| | | | |
|---|---|---|---|
| DE | 2100308 | A | 7/1971 |
| DE | 2127830 | A | 12/1971 |
| DE | 2127830 | B2 | 12/1971 |
| DE | 2629.527 | A | 1/1978 |
| DE | 29606174 | U1 | 8/1996 |
| GB | 1345531 | A | 1/1974 |
| GB | 1345534 | A | 1/1974 |
| GB | 2258025 | A | 1/1993 |

*Primary Examiner*—Charles E. Phillips
(74) *Attorney, Agent, or Firm*—Michael H. Jester

(57) ABSTRACT

A closet flange is provided for coupling the base of a toilet to a drain pipe. A main generally cylindrical body portion is dimensioned for connection to the upper end of a drain pipe and has a through bore for communicating with the interior of the drain pipe. An attachment flange portion extends radially outward from an upper end of the cylindrical body portion and is configured for connecting to the base of a toilet. A knockout temporarily seals the through bore and is removable by breaking away a peripheral edge of the knockout. A retainer extends radially inward from an inner wall of the cylindrical portion below the knockout and is configured to prevent the knockout from falling down the through bore and into the drain pipe when broken away in order to prevent drain clogging.

18 Claims, 2 Drawing Sheets

CLOSET FLANGE WITH KNOCKOUT RETAINER

FIELD OF THE INVENTION

The present invention relates to plumbing parts and more particularly to flanges for connecting a toilet to a drain pipe.

BACKGROUND OF THE INVENTION

In residential and commercial building construction it is necessary to connect the base of a porcelain toilet to a drain pipe in a secure and water tight manner that meets all plumbing codes applicable in the local jurisdiction. The most common way of achieving this connection is to utilize a so-called closet flange. See for example U.S. Pat. Nos. 3,181,585; 3,339,215; and 4,090,267. The typical closet flange is flat and round and includes a pair of semi-circular diametrically opposed key-shaped slots which allow for the insertion of bolts that are used to tighten the base of the toilet to the flange. Early closet flanges were made of cast iron and were connected to cast iron drain pipes. Modem closet flanges are typically made of ABS or PVC plastic and include a main cylindrical body portion that is solvent welded to a drain pipe made of a similar plastic and an attachment flange portion that extends radially from the upper end of the main cylindrical body portion and is bolted to the base of the toilet.

A problem continually faced by plumbers involves the prevention of clogging of toilet drain pipes during construction owing to the fact that these pipes are usually installed long before the toilet is mounted over the same. Sawdust, nails, wood chips, putty, screws, tape, paper, and even blocks of wood fall into the open upper ends of the drain pipes and cause major blockages after the newly completed building is occupied. Some plumbers use cloth, plastic or tape as temporary coverings. However, since most plumbing codes require pressure testing of the drain system to detect leaks, it is necessary to provide an air tight seal. Mechanical and pneumatic test plugs have been used with some success, but when the test is completed the drain pipe remains unsealed. Since the upper end of the pipe is at floor level, debris naturally falls into the drain pipe. Gluing on a pressure test cap is time consuming and its removal is difficult.

U.S. Pat. No. 5,115,554 of Fell, Sr. discloses a closet flange with a screw plug for sealing its axial bore. This requires pipe threads to provide an airtight seal, and such threads are not practical to form during injection molding of a single unitary closet flange. Therefore closet flanges have been molded with integral knockouts.

U.S. Pat. No. 4,827,539 of Kiziah discloses a closet flange with an integral knockout plug 10' which can fall well down into the drain pipe during attempted removal of the plug making it extremely difficult to retrieve U.S. Pat. No. 5,377,361 of Piskula discloses a closet flange with a knock out element that has a diameter larger than an internal diameter of a lower portion of the cylindrical body portion to prevent the knock out element from falling down into the drain pipe.

It would therefore be desirable to provide a plastic closet flange with a main cylindrical body portion that could be solvent welded around the outside of a standard smaller size, e.g. a three inch diameter plastic drain pipe, or within the inside of a standard larger size, e.g. a four inch diameter plastic drain pipe, and which is configured so that its knockout cannot fall down inside either the smaller or larger size of drain pipe.

SUMMARY OF THE INVENTION

According to the present invention, a closet flange is provided for coupling the base of a toilet to a drain pipe. A main generally cylindrical body portion is dimensioned for connection to the upper end of a drain pipe and has a through bore for communicating with the interior of the drain pipe. An attachment flange portion extends radially outward from an upper end of the cylindrical body portion and is configured for connecting to the base of a toilet. A knockout temporarily seals the through bore and is removable by breaking away a peripheral edge of the knockout. A retainer extends radially inward from an inner wall of the cylindrical portion below the knockout and is configured to prevent the knockout from falling down the through bore when broken away.

DESCRIPTION OF THE PREFERRED EMBODIMENT

Figure 3:
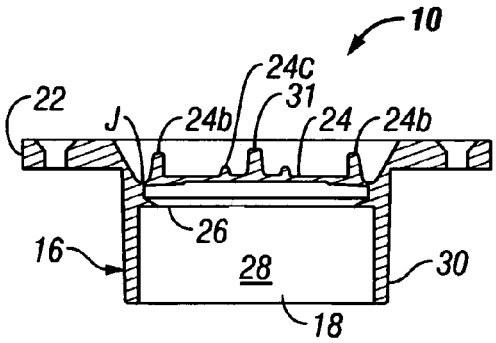
FIG. 3 is a vertical sectional view of the closet flange of FIG. 1.
Figure 4:
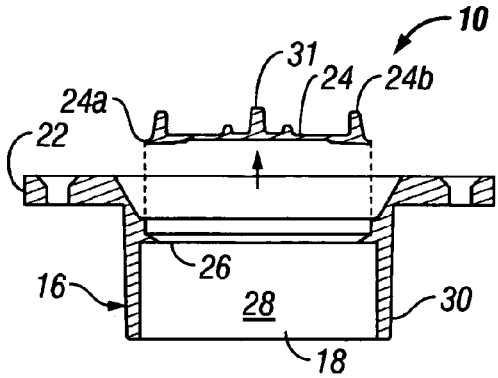
FIG. 4 is a view similar to FIG. 3 illustrating upward removal of the knockout of the closet flange after it has been broken away.
Figure 5:
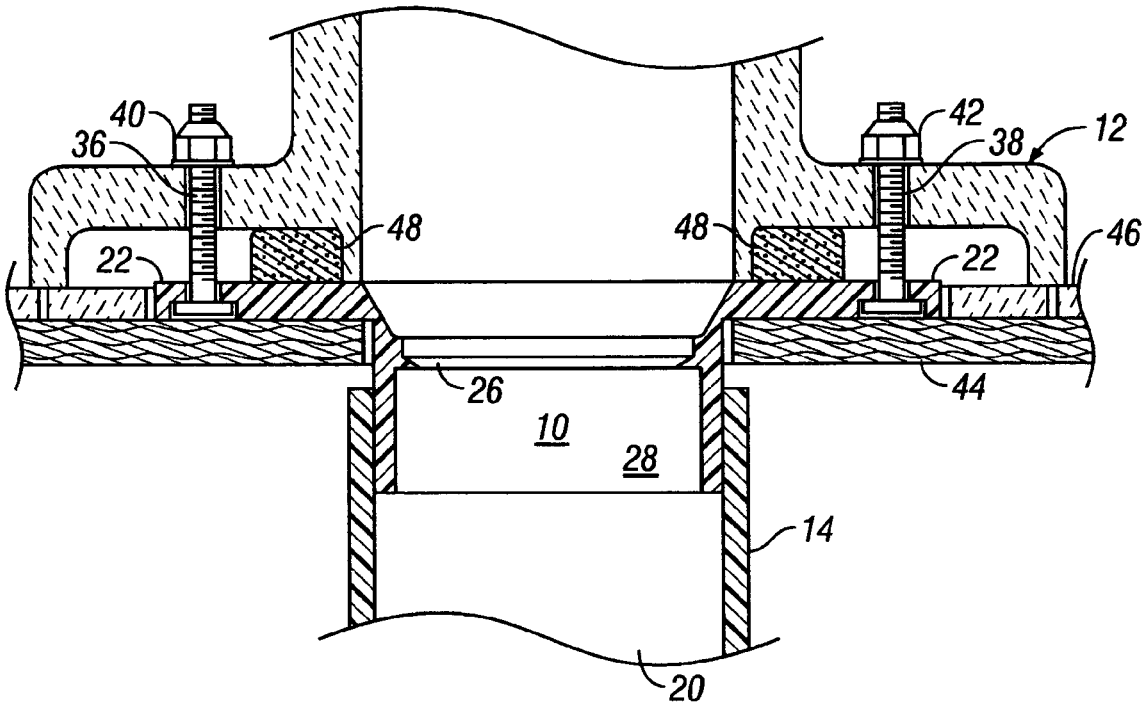
FIG. 5 is a vertical sectional view illustrating the mounting of the closet flange of FIG. 1 in the floor of a residence to couple the base of a toilet to the upper end of a drain pipe with the closet flange mounted inside a standard larger size drain pipe.

Referring to FIG. 5, a plastic closet flange 10 is provided for coupling the base of a conventional porcelain toilet 12 to a plastic drain pipe 14. A main generally cylindrical body portion 16 (FIG. 2) is dimensioned for connection to the upper end of the drain pipe 14 and has a through bore 18 (FIG. 3) for communicating with the interior 20 (FIG. 5) of the drain pipe 14. An annular attachment flange portion 22 (FIG. 1) extends radially outward from an upper end of the cylindrical body portion 16 and is configured for connecting to the flat underside of the base of the toilet 12. A generally disc-shaped knockout 24 temporarily seals the through bore 18 and is removable by breaking away a peripheral edge 24*a* (FIG. 4) of the knockout 24. A retainer 26 (FIGS. 2 and 3) extends radially inward from an inner wall 28 of the cylindrical portion 16 below the knockout 24 and is configured to prevent the knockout 24 from falling down the through bore 18 and down the interior 20 of the drain pipe 14 when broken away.

The closet flange 10 is preferably injection molded as a single unitary piece of ABS or PVC plastic suitable for solvent welding to drain pipe made of similar plastic. Various part number, UPC codes, patent numbers, trademarks, cryptic installation instructions and so forth can be molded into the upper surface of the attachment flange portion 22 in the form of raised indicia (not illustrated). Cryptic installation instructions can also be molded into the upper side of the knockout 24 in the form of raised indicia (not illustrated).

Figure 6:
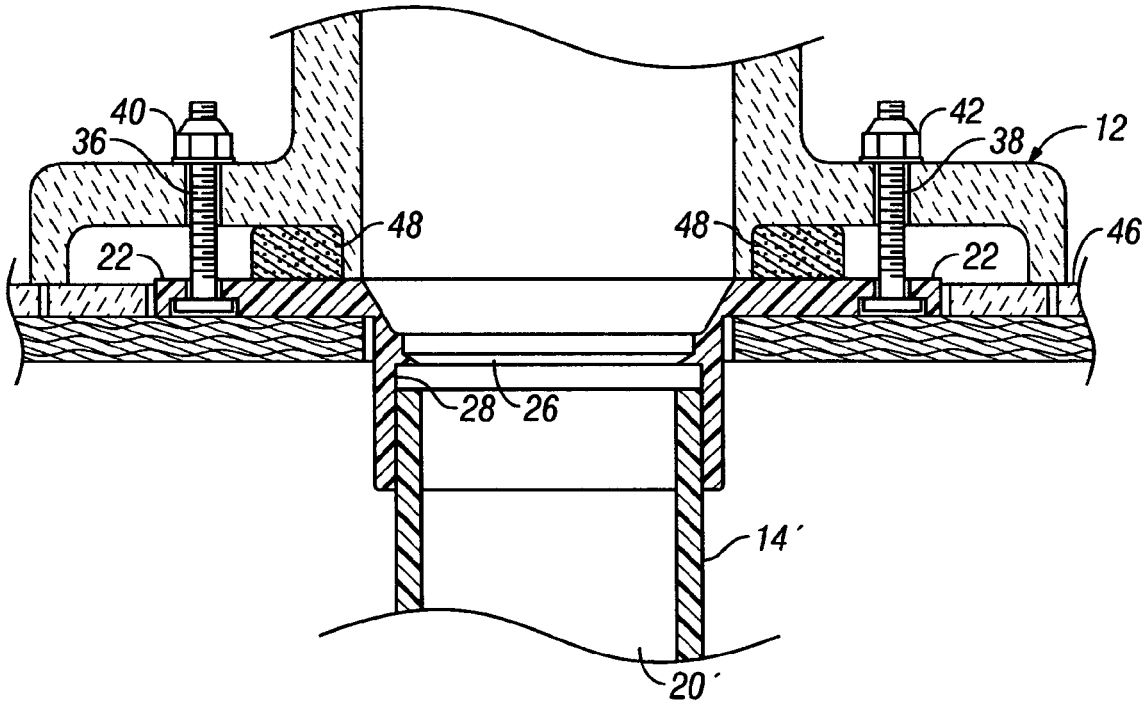
FIG. 6 is a view similar to FIG. 5 except that the closet flange is mounted over the outside of a standard smaller size drain pipe.

The cylindrical body portion 16 is dimensioned for solvent welding around the outside of a standard smaller size diameter plastic drain pipe 14' illustrated in FIG. 6, or within the inside of a standard larger size diameter plastic drain pipe 14 illustrated in FIG. 5. By way of example, the smaller size pipe 14' (FIG. 6) may have an outer diameter of three inches and the larger size pipe 14 (FIG. 5) may have an outer diameter of four inches. The closet flange 10 should be made of the same type of plastic as the pipe 14 or pipe 14' so that the proper solvent can be utilized to create a very high strength weld that is airtight. The diameter of the through bore 18 (FIGS. 3 and 4) in the cylindrical portion 16 is close to outer diameter of the smaller size pipe 14' (FIG. 6) so that the latter will fit snugly into the through bore 18. The outer diameter of the cylindrical portion 16 (FIG. 3) is preferably close to the inner diameter of the interior 20 (FIG. 5) of the larger size pipe 14 so that the cylindrical portion 16 will fit snugly over the outside of the pipe 14. The radial thickness of the cylindrical body portion 16 is chosen to permit the closet flange 10 to alternately fit snugly over the outside of the smaller size pipe 14' or snugly into the inside of the large size pipe 14. The inner wall 28 (FIG. 2) and the outer wall 30 (FIGS. 3 and 4) of the cylindrical body portion 16 are both preferably tapered and converge slightly in the direction moving downwardly from the attachment flange portion 22.

Figure 2:
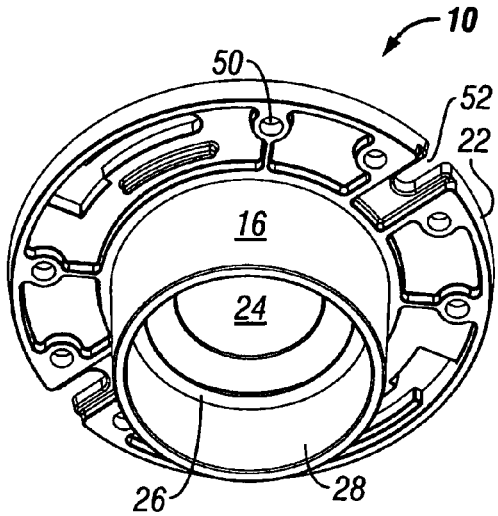
FIG. 2 is a bottom side perspective view of the closet flange of FIG. 1.

The retainer 26 (FIGS. 2–4) is an annular lip formed on the inner wall 28 of the cylindrical portion 16 that projects radially a short distance into through bore 18. The inner diameter of the retainer 26 is smaller than the outer diameter of the knockout 24 so that when the knockout 24 is broken away as illustrated in FIG. 4 it cannot fall downwardly past the retainer 26, through the cylindrical portion 16, and into either the interior 20 of the pipe 14 or the interior 20' of the pipe 14'. It could be extremely difficult to retrieve the broken away knockout 24 from the drain system incorporating the drain pipes 14 or 14' if the closet flange 10 did not have the retainer 26. Retrieval from the drain system would be required or else the drain system would later experience a major clog, backing up the toilet 12. Use of a smaller diameter knockout saves material costs. The inner diameter of the retainer 26 must not be too small or else it will disadvantageously narrow the through bore 18 and thus the drain passage between the toilet 12 and the drain pipe 14 or the drain pipe 14'.

The knockout 24 is recessed from an upper surface of the attachment flange portion 22. This prevents tradesmen from inadvertently breaking away the knockout 24 by stepping on the closet flange 10 or equipment causing the same thing as occurs with the toilet flange of U.S. Pat. No. 5,377,361 of Piskula. As best seen in FIG. 3, the peripheral edge 24*a* of the knockout 24 is integrally. formed with the junction J of the cylindrical body portion 16 and the attachment flange portion 22. As best seen in FIG. 4, the diameter of the knockout 24 is slightly smaller than the diameter of the through bore 18. In the absence of the retainer 26, once broken away at the junction J, the knockout 24 could accidentally fall down the through bore 18 and into the interior 20 of the pipe 14 or into the interior 20' of the pipe 14'.

Figure 1:
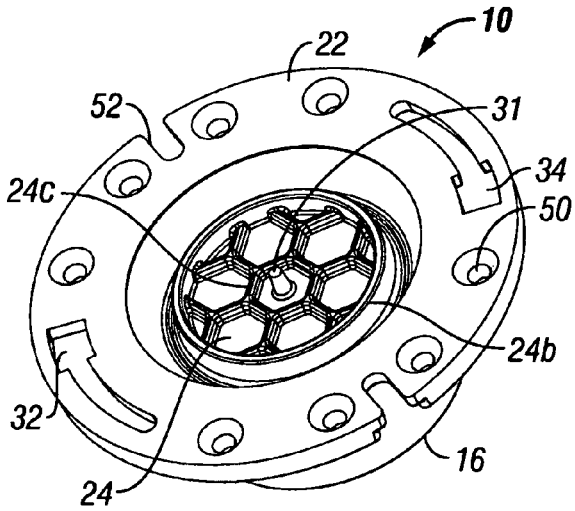
FIG. 1 is a top side perspective view of a closet flange representing one embodiment of the present invention.

The knockout 24 is formed with a raised ring 24*b* (FIGS. 1 and 4) configured for gripping with pliers to facilitate breaking away the knockout 24 all the way around the circumference of the junction J. A small tapered post 31 (FIGS. 1 and 4) extends upwardly from the center of the knockout 24 and may be gripped between the thumb and forefinger when the pliers are being used to break the thin junction. This facilitates upward removal of the knockout after it has been completely broken away. The knockout 24 is formed with a hexagonal pattern of raised reinforcing ribs 24*c* (FIGS. 1 and 3).

The attachment flange portion 22 is formed with a pair of semi-circular diametrically opposed key-shaped slots 32 and 34 (FIG. 1) for receiving bolts 36 and 38 (FIG. 5) which are used to secure the flat underside of the base of the toilet 12 to the attachment flange portion 22 via nuts 40 and 42. The cylindrical portion 16 extends through a hole in a plywood sub-floor 44 with the attachment flange portion 22 overlapping the sub-floor 44. The sub-floor 44 is covered with ceramic tile 46 or other flooring for a bathroom. A wax ring 48 provides a watertight seal between the underside of the base of the toilet 12 and the upperside of the attachment flange portion 22. Counter-sunk holes 50 and edge recesses 52 (FIGS. 1 and 2) are formed in the attachment flange portion 22 to facilitate other forms of connection between the closet flange 10 and the toilet 12.

While an embodiment of the present invention has been described in detail, it will be apparent to those skilled in the art that the embodiment illustrated can be modified in arrangement and detail. For example, the retainer 26 could be a plurality of circumferentially spaced, radially inwardly directed tabs or projections instead of a continuous annular lip. The knockout junction J could be formed only between the knockout 24 and the attachment flange portion 22 or only between the knockout 24 and the cylindrical body portion 16. The configuration of the knockout 24 could be widely varied. The closet flange 10 need not be configured to alternately accommodate smaller and larger size drain pipes. Therefore the protection afforded the invention should only be limited in accordance with the following claims.

I claim:

1. A closet flange for coupling the base of a toilet to a drain pipe, comprising:

a main generally cylindrical body portion dimensioned for connection to the upper end of a drain pipe and having a through bore formed by an inner wall of the cylindrical body portion for communicating with the interior of the drain pipe;

an attachment flange portion extending radially outward from an upper end of the cylindrical body portion and configured for connecting to the base of a toilet;

a knockout temporarily attached to the inner wall of the cylindrical body portion for sealing the through bore and removable by breaking away a peripheral edge of the knockout at a junction with the inner wall of the cylindrical body portion; and a retainer extending radially inwardly from the inner wall of the cylindrical body portion below the region where the knockout is attached and having an inner diameter smaller than an outer diameter of the knockout to prevent the knockout from falling down and through bore when broken away, the through bore having a diameter below the retainer which is larger than the outer diameter of the knockout.

2. The closet flange of claim 1 wherein the cylindrical body portion is made of plastic and is dimensioned for solvent welding around the outside of a standard smaller size diameter plastic drain pipe, or within the inside of a standard larger size diameter plastic drain pipe.

3. The closet flange of claim 1 wherein the attachment flange portion has an annular shape.

4. The closet flange of claim 1 wherein the retainer is an annular lip.

5. The closet flange of claim 1 wherein the knockout is formed with a raised ring configured for gripping with pliers to facilitate breaking away the knockout.

6. The closet flange of claim 1 wherein the peripheral edge of the knockout is integrally formed with a junction of the cylindrical body portion and the attachment flange portion.

7. The closet flange of claim 1 wherein the attachment flange portion is formed with a pair of semi-circular diametrically opposed key-shaped slots.

8. The closet flange of claim 1 wherein the inner wall of the cylindrical body portion is tapered.

9. The closet flange of claim 1 wherein the knockout is recessed from an upper surface of the attachment flange portion.

10. The closet flange of claim 1 wherein the knockout is formed with a pattern of reinforcing ribs.

11. A closet flange, comprising:

a plastic cylindrical body portion dimensioned for solvent welding around the outside of a standard smaller size diameter plastic drain pipe, or within the inside of a standard larger size diameter plastic drain pipe, and having a through bore formed by an inner wall of the cylindrical body portion for communicating with the interior of the drain pipe;

a plastic attachment flange portion extending radially outwardly from an upper end of the cylindrical body portion and configured for connecting to the base of a toilet;

a plastic knockout attached to the inner wall of the cylindrical body portion for temporarily sealing the through bore and removable by breaking away a peripheral edge of the knockout at a junction with the inner wall of the cylindrical body portion, the knockout having an outer diameter less than a diameter of the through bore of the cylindrical body portion; and a plastic retainer in the form of an annular lip extending radially inwardly from the inner wall of the cylindrical portion below the knockout and having an inner diameter smaller than the outer diameter of the knockout to prevent the knockout from falling down the through bore when broken away and to form a downwardly facing surface opposing a butt end of the standard smaller size drain pipe.

12. The closet flange of claim 11 wherein the attachment flange portion has an annular shape.

13. The closet flange of claim 11 wherein the knockout is formed with a raised ring configured for gripping with pliers to facilitate breaking away the knockout.

14. The closet flange of claim 11 wherein the peripheral edge of the knockout is integrally formed with a junction of the cylindrical body portion and the attachment flange portion.

15. The closet flange of claim 11 wherein the attachment flange portion is formed with a pair of semi-circular diametrically opposed key-shaped slots.

16. The closet flange of claim 11 wherein the inner wall of the cylindrical body portion is tapered.

17. The closet flange of claim 11 wherein the knockout is recessed from an upper surface of the attachment flange portion.

18. The closet flange of claim 11 wherein the knockout is formed with a pattern of reinforcing ribs.

* * * * *

UNITED STATES PATENT AND TRADEMARK OFFICE

CERTIFICATE OF CORRECTION

PATENT NO. : 7,055,184 B2
APPLICATION NO. : 10/749729
DATED : June 6, 2006
INVENTOR(S) : Jeffrey A. Humber It is certified that error appears in the above-identified patent and that said Letters Patent is hereby corrected as shown below:

In column 4, line 59, Claim 1 should read:

"...prevent the knockout from falling down ~~and~~ the through..."

Signed and Sealed this

Twenty-second Day of August, 2006

JON W. DUDAS
*Director of the United States Patent and Trademark Office*